US006786513B1

(12) United States Patent
Cobben et al.

(10) Patent No.: US 6,786,513 B1
(45) Date of Patent: Sep. 7, 2004

(54) SECURITY DOCUMENT WITH A PERFORATION PATTERN

(75) Inventors: Johannes I. M. Cobben, Veldhoven (NL); Arnoud Augustinus, Eersel (NL); Jan Van Den Berg, Gouda (NL)

(73) Assignees: Industrial Automation Integrators (I.A.I.) B.V. (NL); Enchédé/DSU B.V. (NL)

( * ) Notice: Subject to any disclaimer, the term of this patent is extended or adjusted under 35 U.S.C. 154(b) by 0 days.

(21) Appl. No.: 09/889,598

(22) PCT Filed: Jan. 18, 2000

(86) PCT No.: PCT/NL00/00036

§ 371 (c)(1),
(2), (4) Date: Nov. 21, 2001

(87) PCT Pub. No.: WO00/43216

PCT Pub. Date: Jul. 27, 2000

(30) Foreign Application Priority Data

Jan. 21, 1999 (NL) ..... 1011103
Jun. 28, 1999 (NL) ..... 1012460

(51) Int. Cl.[7] ..... B42D 15/00

(52) U.S. Cl. ..... 283/72; 283/81; 283/105; 283/901; 428/40.1; 428/42.1; 428/42.2

(58) Field of Search ..... 283/72, 81, 93, 283/94, 99, 105, 901; 428/40.1, 42.1, 42.2

(56) References Cited

U.S. PATENT DOCUMENTS 5,550,346 A * 8/1996 Andriash et al. ..... 219/121.72
5,609,938 A * 3/1997 Shields ..... 428/138
6,328,342 B1 * 12/2001 Belousov et al. ..... 283/91
6,494,491 B1 * 12/2002 Zeiter et al. ..... 283/91
2002/0027359 A1 * 3/2002 Cobben et al. ..... 283/67

FOREIGN PATENT DOCUMENTS

| | | | |
|---|---|---|---|
| EP | 0185807 | A1 | 7/1986 |
| EP | 0853296 | A1 | 7/1998 |
| WO | WO 95/26274 | A1 | 11/1995 |
| WO | WO 97/18092 | A1 | 5/1997 |

* cited by examiner

*Primary Examiner*—Monica S. Carter
(74) *Attorney, Agent, or Firm*—Banner & Witcoff Ltd.

(57) ABSTRACT

The invention relates to a forge-proof document comprising a security feature in the form of a perforation pattern which displays gray tones when viewed against a bright background, wherein the document is manufactured from a material which transmits light to a limited extent, at least some of the perforations forming part of the perforation pattern extend over only a part of the thickness of the document at the position of the perforation, and the thickness of the remaining part of the document at the position of the perforation is modulated in accordance with the image to be displayed. The invention also relates to such a document comprising a security feature in the form of a perforation pattern which displays gray tones when viewed against a bright background, wherein at least some of the perforations forming part of the perforation pattern extend at an angle differing from 90° relative to the main plane of the document.

23 Claims, 1 Drawing Sheet

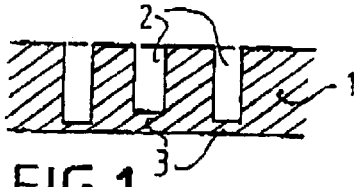
FIG.1
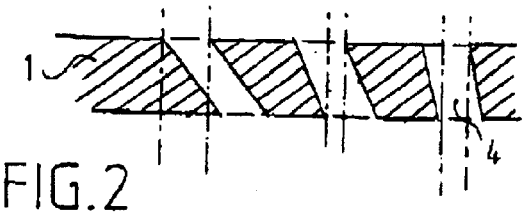
FIG.2
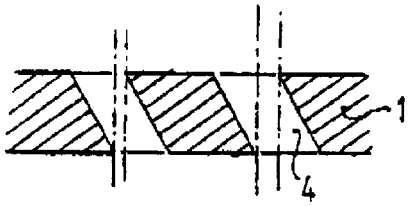
FIG.3
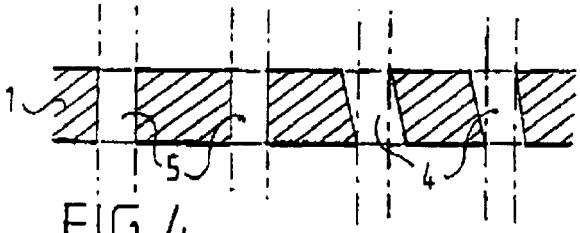
FIG.4
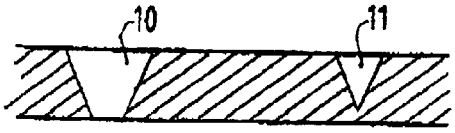
FIG.5
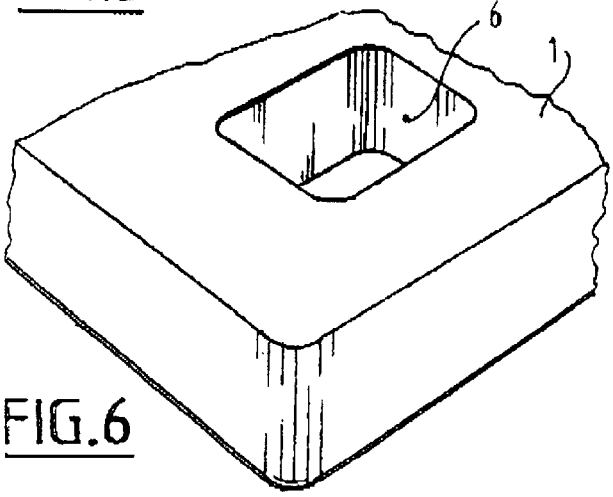
FIG.6
FIG.7
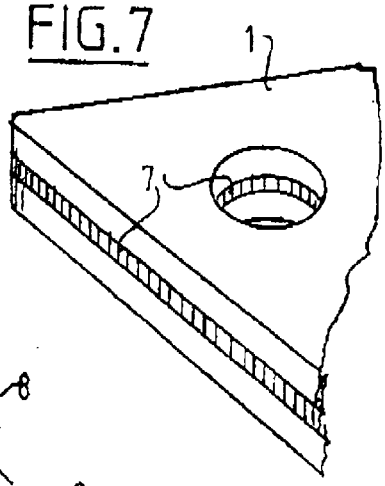
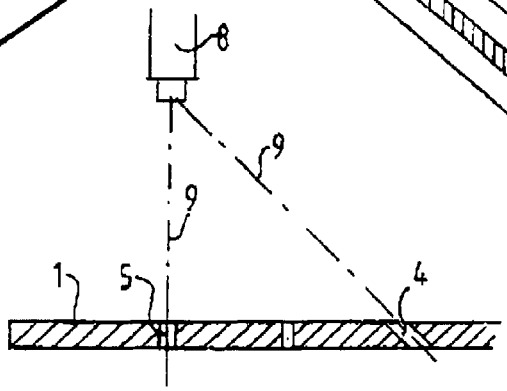
FIG.8
FIG.9
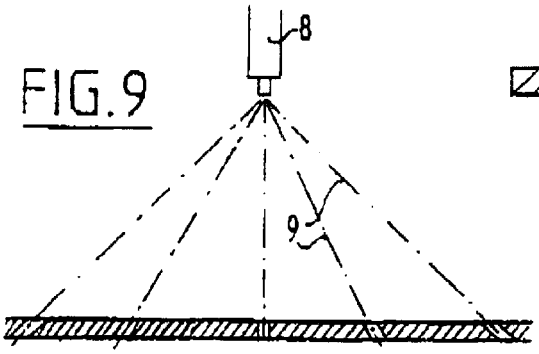

SECURITY DOCUMENT WITH A PERFORATION PATTERN

FIELD OF THE INVENTION

The present invention relates to a forge-proof document comprising a security feature in the form of a perforation pattern which displays gray tones when viewed against a bright background.

BACKGROUND OF THE INVENTION

Such a document is known from W098/19869.

Although the prior art document in question provides a very good security against forgery, it is important to develop new security features in respect of the technical potential of forgers.

BRIEF DESCRIPTION OF THE INVENTION

For this purpose, the present invention provides the measure that the document is manufactured from a material which transmits light to a limited extent, that the perforation extends over only a part of the thickness of the document at the position of the perforation, and that the thickness of the remaining part of the document at the position of the perforation is modulated in accordance with the image to be displayed.

This measure results in a further degree of difficulty; the determining factor for displaying the gray tone of the perforation, and therewith the image, is determined by the remaining thickness of the document. This means that the depth of the non-continuous perforation must be determined very precisely. The resulting thickness is after all the difference between two larger values, i.e., the thickness of the total document and the depth of the perforation.

According to another independent measure according to the invention, the perforation extends at an angle differing from 90° relative to the main plane of the document. This has the result that the perforation cannot be arranged with very small drills, but that use will have to be made of a laser which, on the one hand, requires a large investment and, on the other, requires a high degree of technical knowledge.

This method of arranging provides the option of modulating the angle so as to obtain a gray-value modulation.

There is moreover the possibility, as in the classic straight perforations, of modulating the density of the perforation or the size, i.e., the diameter, thereof.

The perforation is preferably an image.

It is herein noted that the image as arranged by means of perforation can be subjected to a certain degree of image-processing. It is hereby possible to compensate the features of the image lost due to the necessary quantization. An example of such an image-processing is "contour enhancement."

The invention is also applicable to perforation patterns which do not represent an image, but which represent an alphanumeric expression or a code.

It will be apparent that a combination of these possibilities can be applied. Such an oblique perforation can of course be combined with a normal straight perforation This combination provides the option of introducing an extra pattern. The main image, which is modulated in order to display gray tones, is for instance arranged herein with a straight perforation, while an additional feature, for instance in the form of a logo or letters, is arranged obliquely. The choice of the angle or other properties of the oblique perforation can be chosen such that during normal observation of the pattern at an angle of about 90° the normal image appears, and that during observation at another angle the second image in the form of a logo or a letter combination becomes visible.

Another example is the arranging of two images at the same position on the carrier, although at different angles such that each eye sees its own image, and a stereo image is thus observed.

It will be apparent that this can be varied in numerous ways.

It is attractive herein to make use of a method wherein the document to be protected is irradiated by a laser source from two positions. It is of course possible herein to make use of two laser sources, although it is simpler to first irradiate the document in a first position with a laser source at a first angle and to then place the document in a different position wherein it is irradiated by the same laser source at a different angle.

When the laser source is placed close to the document, it is also possible to arrange a perforation at an angle differing from 90°; this is caused by the cone or pyramid shape inside which the laser light beam must displace in order to arrange the perforation. A pattern then results which has an increasing angle as the distance to the center of the image increases.

According to another preferred embodiment of the invention, the cross-section of the perforation in its transverse plane is unequal to a circle. The use of a laser source provides the possibility of performing such a perforation when there is a correct control of the positions of the laser spot. It is, in any case, practically impossible to obtain this with mechanical means in view of the fineness of the required pattern.

According to another preferred embodiment, a code is concealed in the representation of the image. Use can be made herein of the teachings already applied in graphic techniques, according to which it is possible to arrange changes in an image which are not visible to the normal eye and which result after a specific processing in a code being displayed.

Conversely, an immediately visible coding can also be chosen. The code can be used, for instance, to identify the machine on which the relevant product was made. The relevant machine can thus be identified in the case of improper use of a machine.

According to yet another embodiment, an intermediate layer is arranged in the document, which layer is provided with an ink.

The use of laser provides the possibility of complete removal, i.e., burning, evaporating and so on, of the material from which the document is manufactured. Contamination of the relevant layers of the document will herein hardly occur. When such a document is processed with mechanical means, a degree of smearing will occur.

This smearing can be observed particularly well when the ink is formed by ink sensitive in UV light.

According to another embodiment, perforations arranged in a carrier in a pattern representing an image are filled with an ink which lights up under UV light. Such a pattern becomes visible if it is illuminated with a UV light source.

In another embodiment, the inner sides of the perforations of such a pattern are provided with a layer, for instance by vapor-deposition of a reflecting metal layer, resulting in an image which is visible when viewed. Selective application of a layer to the inner side of all perforations is possible by arranging a removable foil before the perforations are arranged and removing it after said layer has been applied.

In another embodiment, the starting point is a carrier which is built up of material layers of different colors. By modulating the depth, the perforation can be made to end in the desired layer and thereby make a desired color visible. An image in color can thus be realized.

The invention further provides the option of arranging the perforation in a protected element mounted on the carrier, such as an optically variable element such as a hologram or a kinegram. Such security features are not accessible to a forger, since they are only transacted between one manufacturer and one buyer. By furthermore providing such a security feature with a personalized perforation pattern, the forger is also deprived of the possibility of transferring such an element from one document to another.

When the image represented by the perforation pattern corresponds with another image arranged on the document, it is possible to have the images coincide. This provides the option of having both images coincide precisely. This has as advantages: the problems for the forger and counterfeiter increase, verification becomes even faster and simpler, and no extra surface area is required for the perforated image.

BRIEF DESCRIPTION OF THE DRAWINGS

The present invention will be elucidated hereinbelow with reference to the annexed drawings, in which:

FIG. 1 shows a cross-sectional view of a first embodiment of a document according to the present invention;

FIG. 2 shows a cross-sectional view of a second embodiment of a document according to the present invention;

FIG. 3 shows a cross-sectional view of a third embodiment of a document according to the present invention;

FIG. 4 is a cross-sectional view of a fourth embodiment of a document according to the present invention;

FIG. 5 is a cross-sectional view of a fifth embodiment of a document according to the present invention;

FIG. 6 shows a schematic perspective detail view of a sixth embodiment of the invention;

FIG. 7 is a schematic perspective detail view of a seventh embodiment of the invention;

FIG. 8 is a cross-sectional view of an eighth embodiment of the invention, which also serves to elucidate the method used therein; and FIG. 9 shows a cross-sectional view of a ninth embodiment of the present invention.

DETAILED DESCRIPTION OF THE INVENTION

FIG. 1 shows a cross-section of a document 1. Document 1 is manufactured from plastic but can likewise be manufactured from another material, such as paper, textile, and it can also be manufactured from laminated material, wherein a combination of diverse material types is made.

As elucidated in the international patent application with publication number W098/19869, such a document is provided with perforations. In FIG. 1, the perforations 2 have been arranged. In this first embodiment of the present invention, perforations 2 do not extend through the whole thickness of document 1, but leave a part 3 of the document intact.

The remaining parts 3 of the diverse perforations are herein of differing thickness. They therefore transmit light to a greater or lesser extent and, when the document is held against the light, an image comprising gray tones will result subject to the thickness of the remaining part 3 and the depth of perforation 2.

According to an embodiment as shown in FIG. 2, the perforations are arranged obliquely, i.e., at an angle differing from 90° relative to the main plane of the document. It is herein possible to obtain a modulation of the gray tones by varying the relevant angle. This is elucidated with dotted lines in FIG. 2.

It is further possible, as shown in FIG. 3, to modulate the width, i.e., the diameter of holes 4. It is of course possible here to combine both forms of modulation. It is moreover possible to combine one of the two modulation forms or both of them with modulation of the density of the perforations.

It is of course possible to assign determined properties to such a combination of modulation methods. An example hereof is shown in FIG. 4.

When the document is viewed straight on, as indicated with dotted lines in FIG. 3, a similar gray tone is herein displayed for each of the perforations. This gray tone can be modulated by varying the density or by varying the size of the perforations. It is herein possible according to the invention to generate an image.

Owing to the fact that both perforations 4 are arranged obliquely, it is possible to provide these perforations with extra information, for instance by arranging them in the form of a letter or a logo. This is of course only visible when the image is viewed at a determined angle.

In the embodiment shown in FIG. 5, a perforation in the form of a cone or in the form of a truncated cone is obtained in both cases. Modulation of the visible gray tone can herein be obtained by varying the "depth" of the cone or its apex angle. Thus, this forms a combination of depth of hole modulation and diameter of hole modulation. Perforation 10 is thus, for instance, continuous, while perforation 11 is blind.

It is further possible, as shown in FIG. 6, to arrange a perforation in a form differing from a circle, for instance a rectangle 6. The rectangular perforation can be difficult to obtain with mechanical means, so that a laser is necessary for this purpose. A laser beam can after all be controlled such that it causes a perforation with such a contour, provided the focusing is sufficiently fine. It will be apparent that other shapes are possible, such as triangles, squares, ovals and so on.

FIG. 7 shows a configuration wherein this document is provided with layer 7 provided with ink. This layer is not particularly noticeable when the perforation is arranged with a laser, this layer is also removed by the laser. When an attempt is made to provide such a document with a perforation by means of mechanical means, for instance drilling, the ink will smear, which is clearly visible.

Such a configuration can also be applied to laminated cards, the inner layer of which has a color, for instance white, which differs from the colors of the other layers.

FIG. 8 shows how it is possible, using the same laser light source 8, to provide the same document 1 in different positions with a straight perforation 5 and subsequently with an oblique perforation 4. It is of course essential herein that the laser light beam 9 leaving laser source 8 can be deflected sufficiently. In addition, accurate stops and the like are necessary for the required precision in the positioning of document 2 in the different positions. It will be apparent that it is possible to perforate the document from more than two positions.

Finally, FIG. 9 shows an embodiment wherein laser light source 8 is placed relatively close to document 1, so that as a result of the angular deviation there result perforation which extend at a different angle. It will further be apparent that it is possible within the scope of the present invention to vary in countless ways from the shown embodiments.

What is claimed is:

1. Forge-proof document comprising a security feature in the form of a perforation pattern which displays gray tones when viewed against a bright background, wherein the perforations are produced by a laser and wherein at least some of the perforations forming part of the perforation pattern extend at an angle differing from 90° relative to the main plane of the document.

2. Document as claimed in claim 1 wherein a code is concealed in the representation of an image.

3. Document as claimed in claim 1 wherein the density or the diameter of the perforation is modulated in order to obtain the image.

4. Document as claimed in claim 1 wherein the angle is modulated in order to obtain the image.

5. Document as claimed in claim 4 wherein the perforation pattern is adapted to present a stereo image to the observer from a viewing position.

6. Document as claimed in claim 4 wherein the perforation pattern is adapted to present to the user an image which differs per angle of view.

7. Document as claimed in claim 6 wherein the angle of the perforations to the main plane of the document increase as the distance to the center of the perforation pattern increases.

8. Forge-proof document comprising a security feature in the form of a perforation pattern which represents an image and which displays gray tones when viewed against a bright background wherein material is arranged in the perforations.

9. Document as claimed in claim 8 wherein the material is formed by ink which lights up under UV light.

10. Document as claimed in claim 8 wherein a vapor-deposited metal layer is arranged in the perforations.

11. Document as claimed in claim 8 wherein the document comprises differently colored material layers, wherein a color is visible depending on the depth of the perforation.

12. Document as claimed in claim 11 wherein the document is manufactured from plastic laminate and that the core layer has a color differing from the other layers.

13. Document as claimed in claim 8 wherein the perforation pattern is further provided with perforations modulated in density or size.

14. Document as claimed in claim 8 wherein the perforation pattern is provided locally with a perforation pattern differing from the rest of the perforation pattern.

15. Document as claimed in claim 8 wherein the cross-section of the perforation pattern in its transverse plane is unequal to a circle.

16. Document as claimed in claim 8 wherein an intermediate layer with an ink is arranged in the material.

17. Document as claimed in claim 16 wherein the ink is only visible ink in UV light.

18. Document as claimed in claim 8 wherein the perforation is arranged in a protected element mounted on the material.

19. Document as claimed in claim 8 wherein the image represented by the perforation pattern corresponds with an image applied by means of graphic techniques, laser engraving technique or a photo, wherein both images coincide.

20. Document as claimed in claim 19 wherein the images are personalized.

21. Method for arranging a perforation pattern in a forge-proof document comprising a security feature in the form of a perforation pattern which displays gray tones when viewed against a bright background, the method comprising the following steps:

arranging the document to be provided of a perforation pattern in a position in which it can be irradiated by a laser source; and irradiating the document by a laser source which is controlled to obtain a first image in the document wherein:

amending the relative position of the document and the laser source; and subsequently irradiating the document by said laser source which is controlled to obtain a second image.

22. Method for arranging a perforation pattern in a forge-proof document comprising a security feature in the form of a perforation pattern which displays gray tones when viewed against a bright background, the method comprising the following steps:

arranging the document to be provided of a perforation pattern in a position in which it can be irradiated by a laser source; and irradiating the document by a laser source which is controlled to obtain a first image in the document wherein:

the laser source is programmed to apply a perforation pattern comprising perforations of which the cross-section in the transverse plane of the perforation pattern is unequal to a circle.

23. Method for arranging a perforation pattern in a forge-proof document comprising a security feature in the form of a perforation pattern which displays gray tones when viewed against a bright background, the method comprising the following steps:

applying a foil on the document to be provided of a perforation pattern;

arranging the document in a position in which it can be irradiated by a laser source; and irradiating the document by a laser source which is controlled to obtain a first image in the document wherein:

subsequently the document is subjected to a vapor deposition process; and finally the foil is removed from the document.

* * * * *

UNITED STATES PATENT AND TRADEMARK OFFICE

CERTIFICATE OF CORRECTION

PATENT NO. : 6,786,513 B1 
DATED : September 7, 2004
INVENTOR(S) : Johannes I. M. Cobben et al.

It is certified that error appears in the above-identified patent and that said Letters Patent is hereby corrected as shown below:

Title page,
Item [73], Assignees, replace "Enchédé" with -- Enschédé --.

Signed and Sealed this

Twenty-first Day of February, 2006

JON W. DUDAS
*Director of the United States Patent and Trademark Office*